United States Patent [19]

Hamano

[11] 3,985,358

[45] Oct. 12, 1976

[54] SIMULATED BASEBALL GAME

[75] Inventor: Nobuo Hamano, Tokyo, Japan

[73] Assignee: Tomy Kogyo Co., Inc., Tokyo, Japan

[22] Filed: Sept. 15, 1975

[21] Appl. No.: 613,241

[30] Foreign Application Priority Data

Sept. 17, 1974 Japan ..... 49-112579[U]

[52] U.S. Cl. ..... 273/89; 124/16; 124/36; 273/95 A; 273/98

[51] Int. Cl.[2] ..... A63F 7/06

[58] Field of Search ..... 273/89, 90, 95 A, 98, 273/97 R, 26 E, 58 C, 200 B, 85 R

[56] References Cited

UNITED STATES PATENTS

| | | | |
|---|---|---|---|
| 1,164,044 | 12/1915 | Williamson et al. | 273/89 |
| 1,963,944 | 6/1934 | Hahn et al. | 273/89 |
| 1,994,685 | 3/1935 | Callejas | 273/89 |
| 2,633,320 | 3/1953 | Salmi | 273/26 E |

FOREIGN PATENTS OR APPLICATIONS

| | | | |
|---|---|---|---|
| 591,721 | 1/1934 | Germany | 273/85 R |

*Primary Examiner*—Richard C. Pinkham
*Assistant Examiner*—Harry G. Strappello
*Attorney, Agent, or Firm*—Edward D. O'Brian

[57] ABSTRACT

A simulated baseball game can be constructed so as to utilize a simulated baseball tethered on an arm in such a manner that the ball can be rotated across a simulated baseball playing field. The arm is mounted on a pylon by a universal joint so that it can be rotated generally between the field area of the playing field and the home plate of the playing field. A spring-loaded, latch-controlled propulsion member mounted generally in the field area of the playing field is used to hit the ball so as to cause it to rotate from an at rest position in the field area of the playing field toward and across the home plate of the playing field. A simulated bat may be actuated during such movement of the ball in an effort to hit the ball toward any one of a plurality of targets located in the field area. A base hit or a home run is indicated by the ball hitting a target labeled so as to correspond to such a hit or a home run. A strike is indicated by the simulated bat having been actuated without hitting the ball or by the ball hitting against a designated area in back of the home plate area of the playing field. A ball is designated by the simulated baseball moving past the home plate area of the playing field without being hit and without the ball hitting this designated area.

15 Claims, 11 Drawing Figures

SIMULATED BASEBALL GAME

CROSS-REFERENCE TO RELATED APPLICATIONS

None

BACKGROUND OF THE INVENTION

The invention set forth in this specification pertains to a new and improved simulated baseball game.

Virtually since the advent of the game of baseball various different simulated baseball games have been constructed and used. An understanding of the present invention is not considered to require a detailed discussion of various different prior simulated baseball games. Some of such prior simulated baseball games have been undesirable from a commercial standpoint because they have failed to effectively simulate or suggest the real game of baseball. Many of such prior simulated baseball games have been undesirable because they have tended to be unnecessarily expensive and difficult to manufacture. Frequently such prior simulated baseball games have been undesirable from a practical standpoint because of their complexity.

It would be possible to enter into a detailed, specific discussion of the disadvantages and limitations of virtually all prior simulated baseball games. In general it is considered that all of such prior games are not significantly desirable for one or more of a variety of different reasons such as the reasons discussed in the preceding paragraph. As a result of this it is considered that there is just a need for new and improved simulated baseball games.

BRIEF SUMMARY OF THE INVENTION

A broad object of the present invention is to provide a new and improved simulated baseball game to fulfill the need indicated in the preceding. Other objects of the invention are to provide a simulated baseball game: which effectively simulates or suggests the real game of baseball; which may be easily and conveniently manufactured at a comparatively nominal cost; and which is relatively simple both to construct and to utilize. Various other objectives of the invention will be apparent from a careful consideration of this entire specification and the appended claims.

In accordance with this invention these various objectives are achieved by providing a simulated baseball game having a simulated baseball playing field, a simulated baseball, a tether means for controlling the movement of the ball connected to the ball, a support means for holding the tether means relative to the playing field connected to the tether means, and a simulated bat for hitting the ball in which the improvement comprises: the support means including a pylon extending above the playing field, the tether means comprising an elongated arm, the ball being connected to one end of the arm, universal joint means connecting the arm and pylon for permitting the arm to rotate across the playing field at various levels with respect to the playing field, the pylon and the arm being positioned and dimensioned so that the ball is held in such a manner that it can be rotated between the field area of the playing field and the home plate of the playing field, and propulsion means for hitting the ball to cause the ball to rotate from an at rest position in the field area of the playing field toward and across the home plate of the playing field.

BRIEF DESCRIPTION OF THE DRAWINGS

The invention is best more fully explained with reference to the accompanying drawings in which.

Figure 1:
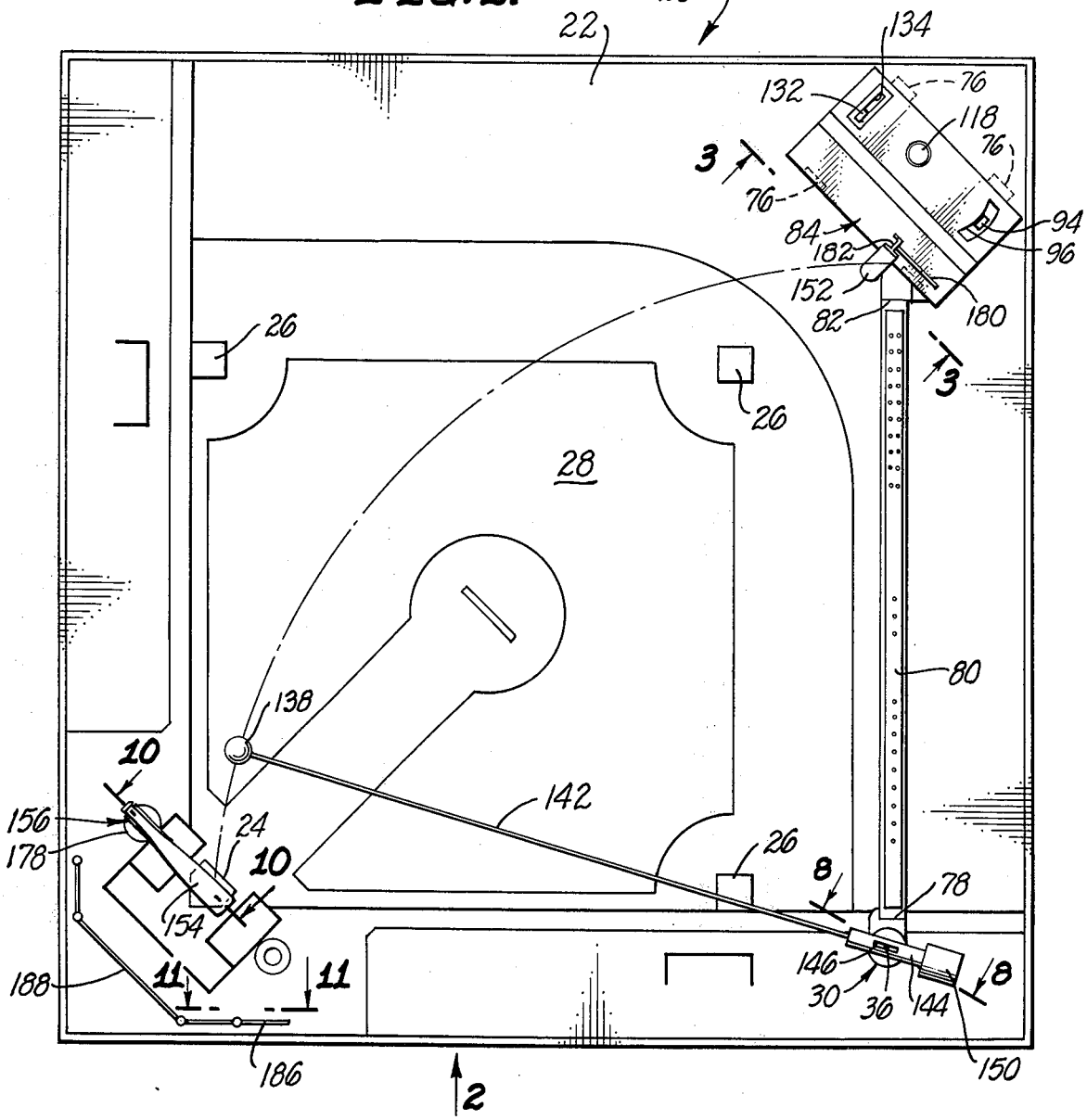
FIG. 1 is a top plan view of a presently preferred embodiment or form of a simulated baseball game of the invention at a point when a simulated ball is being propelled from the field area of a simulated playing field toward the home plate of the playing field.
Figure 2:
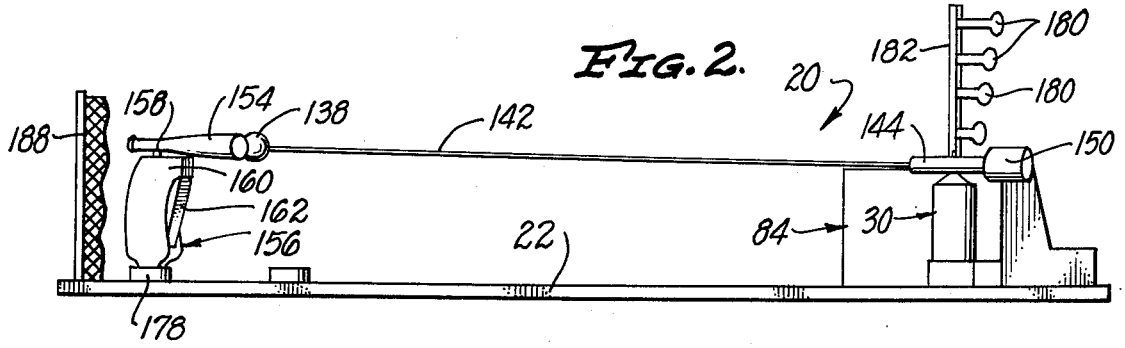
FIG. 2 is a side-elevational view taken in the direction of the arrow 2 in FIG. 1.

Those skilled in the field of designing and constructing toy simulated games will realize that the principles of the invention as are set forth and defined in the appended claims can be utilized in a variety of somewhat differently appearing and somewhat differently constructed simulated baseball games. For this reason the invention is not to be considered as being limited to the precise simulated baseball game structure illustrated in the drawings.

DETAILED DESCRIPTION

A simulated baseball game 20 illustrated in the drawing has a "board" 22 which is appropriately printed or painted so as to simulate a conventional baseball playing field (not separately numbered) including a home plate 24, various bases 26 and a field area 28. In the interest of brevity not all parts of this playing area are specifically identified herein. In a sense the use of the word "board" in designating the part of the game 20 designated by the numeral 22 is a misnomer. Although this board 22 can be formed out of a rigid board or a board-like material normally this board 22 will be formed out of heavy cardboard or the equivalent to facilitate the game 20 being disassembled and folded up for storage purposes.

The game 20 includes a pylon 30 located on the board 22 in a location as shown. This pylon 30 is a hollow structure terminating in an upwardly directed conical wall 32. An opening 34 at the appex of this wall 32 is utilized to support a shaft 36 so that this shaft 36 may be moved vertically with respect to the board 22. The bottom of the shaft 36 carries a small retainer 38 which is utilized in holding a spring 40 in place between the shaft 30 and another retainer 42 located on a cross wall 44 within the pylon 30. With this structure the spring 40 normally biases the shaft 36 upwardly so that it extends from and above the wall 32.

Two other openings 46 are located in the wall 32 parallel to the opening 34. These openings 46 are employed so as to support holding rods 48 so that they can be moved vertically relative to the board 22 upwardly from the wall 32 on diametrically opposite sides of the shaft 36. These rods 48 are preferably formed of a synthetic or similar rubber composition so as to be self-supporting and yet so as to be somewhat resilient. These rods are secured by couplings 50 to corresponding support rigid rods 52 which extend through openings 54 in the cross wall 44.

These rods 52 terminate in ball-like cam followers 56 which ride upon a rotary cam 58. This cam 58 is mounted by a screw 60 on the cross wall 44 in such a manner that it can be turned so that a cam surface 62 on it will engage and push upwardly on either of the followers 46. This cam 58 is restricted to rotation between positions in which either, but not both, of the holding rods 48 may be elevated by stops 64 on it hitting against a projection 66 on the pylon 30. A crank arm 68 is attached by pivots 70 to the cam 58 so as to project outwardly from the pylon 30 through an opening 72 in the base 74 of this pylon 30.

This base 74 is adapted to be interlocked with the board 22 in a conventional manner through the use of a projection 76. It is also adapted to be secured by a conventional coupling joint 78 to an elongated, flat cover 80 extending along the board 22. This cover 80 is also secured to a similar coupling joint 82 on a mounting structure or housing 84. This housing 84 is secured to the board 22 by other projections 76. This assembly is designed so that the cover 80 will conceal and project an elongated link 86 which is used to transmit movement from a control lever 88 in the structure 84 to the cam 58. This link 86 is connected to the crank cam 68 and to another crank arm 90 through the use of conventional pivots 70.

This other crank arm 90 is connected by a further pivot 70 to the lever 88. This lever 88 is mounted intermediate its ends on a pivot 92 and is formed so as to include a control extension 94 extending outwardly through a slot 96 in the structure 84. The lever 88 is held by a coil spring 98 extending between mounting members 100 on the mounting structure 84 and on the lever 88 so that normally the extension 94 is located intermediate the ends of the slot 96. By moving the extension 94 within the slot 96 it is possible to multiply and transmit this motion so as to cause the cam 58 to move so as to elevate either of the holding rods 48 from the conical wall 32.

The mounting structure 84 also includes a propulsion lever or member 102 having shaft-like protuberances 104 fitting within correspondingly shaped bearing sockets 106. With this structure the member 102 is rotatably mounted so as to be capable of being rotated about an axis (not separately numbered) which extends vertically with respect to the board 22. The rotation of the member 102 is controlled in several different ways. A latch arm 108 mounted on the mounting structure 84 through the use of pivots 110 is utilized to control rotation of this member 102. A projection 112 on the arm 108 having a cross-sectional configuration corresponding to a conventional latch hook is employed to achieve this control.

This projection 112 is located on the arm 108 so as to be capable of physically engaging the member 102. This latch projection 112 is normally biased into a position in which the arm 108 is located against the member 102 through the use of a small coil spring 114. This spring 114 fits within sockets 116 on the structure 84 and on the arm 108. This arm 108 carries a control or "pitch" button 118 which extends outwardly from the structure 84 through a hole 120. When this button 118 is pushed the spring 114 will be compressed and the latch arm 108 will be moved generally away from the member 102 so that this member 102 is released so it can rotate.

Such rotation of the member 102 is caused by the release of tension on another spring 122. This spring 122 is hooked around an end 124 of the member 102 and it also is similarly connected to an adjustment slider 126 located within the structure 84. This slider 126 is guided for linear movement within the structure 84 by means of guide rails 128. It is biased generally against the rails 128 and adjacent parts of the structure 84 (not separately numbered) by means of a small leaf spring 130 appearing much as a potentiometer wiper engaging the interior of the structure 84.

This slider 126 has a small control projection 132 which extends outwardly through a slot 134 in the structure 84 in such a manner that the slider 126 may be moved linearly so as to adjust the tension of the spring 122. The leaf spring 130 will normally hold the slider 126 in any operative position corresponding to any desired tension on the spring 122. If desired this leaf spring 130 may resiliently engage detent like grooves (not shown) to guard against undesired movement of the slider 126 caused by the tension of the spring 122. Normally this expedient is not necessary.

The slider 126 and the latch arm 108 are utilized so as to control a hammer-like extension 136 on the member 102 so as to obtain a "pitching" action with the game 20 to propel a simulated ball 138 above and across the board 22 from the field area 28 generally above home plate 24. This extension 136 is adapted to be moved through a hole 140 in the structure 84 when the button 118 is pressed so as to release the projection 112 from engagement with the member 102. When such release occurs the extension 136 will be propelled outwardly through the hole 140 as a result of the release of the tension on the spring 122.

After the extension 136 has been released in this manner through actuation of the arm 108 the member 102 may be reset so that the extension 136 can be released again by pushing the extension 136 generally toward and into the structure 84. As this occurs the projection 112 will ride up over the member 102 and will fit against the member 102 so as to latch or hold it in what may be referred to as a cocked position in which the spring 122 is held under tension.

The ball 138 is tethered through the use of an elongated arm 142 having an enlarged extremity 144. A slot 146 having sloping end walls 148 is located generally around the shaft 36 so that the arm 142 is supported on the conical wall 32 in such a manner that this arm 142 can be rotated generally across and above the board 22 at various different levels with respect to this board 22. In effect, this mounting involving the extremity 144, the slot 146, the shaft 36, and the conical wall 32 constitutes what may be referred to as a universal joint mounting and/or a universal joint type of mounting in that it permits simultaneous rotation of the arm 142 and the ball 138 about a vertically extending axis (not separately identified) as well as about various horizontal axes (not separately identified) passing through the vertical extending axis.

It is noted that the sloping end walls 148 accommodate relative movement between the shaft 36 and the arm 142 so that the ball 138 can change in altitude relative to the board 22 as the arm 142 is rotated about the shaft 36. It is considered that the manner in which this shaft 36 is mounted facilitates the ball 138 and the arm 142 rotating both horizontally and vertically in a manner enabling the movement of the ball 138 to effectively simulate the movement of an actual baseball to as great an extent as reasonably possible. A counterweight 150 is located in the extremity 144 so as to tend to normally hold or bias the arm 142 in a substantially horizontal position.

When the game 20 is to be played the arm 142 is rotated so as to extend downwardly at a slight angle and so as to be located under a small ledge 152 on the structure 84. The action of the counterweight 150 will normally tend to hold the ball 138 in this position after it has been moved to this position. When the ball 138 is in this "at rest" position the control button 118 may be engaged so as to release the member 102 as previously described. As this occurs the extension 136 will move so as to hit against the ball 138 in order to propel it from its at rest position in the field area 28 of the board 22 generally toward and across home plate 24.

As the ball 138 is propelled in this manner it may be engaged through the use of a simulated bat 154. This bat 154 is rotatably mounted upon an actuator 156 through the use of a shaft 158. This actuator 156 includes a handle-like housing 160 shaped to fit the hand of an individual. This housing 160 in turn carries an elongated trigger 162 which is mounted upon a pivot pin 164 so as to extend outwardly from the housing 160 through an opening 166. A small biasing spring 168 is normally employed to bias the trigger 162 toward an extended position. When this trigger 162 is pulled generally toward the housing 160 a small gear rack 170 on the trigger 162 turns a spur gear 172 on the shaft 158 so as to rotate this bat 154.

In the preferred manner of playing the game 20 this actuator 156 will be held so that a bottom knob 174 on it fits within a correspondingly shaped depression 176 in a holder 178 located on the board 22 in such a position that the bat 154 can be swung in a manner corresponding to the manner in which a bat in the real game of baseball is swung relative to home plate in the game. If the actuation of the bat 154 is successful in causing the bat 154 to hit the ball 138 this ball 138 will be engaged so as to reverse the direction of ball movement caused by the actuation of the button 118.

Figure 3:
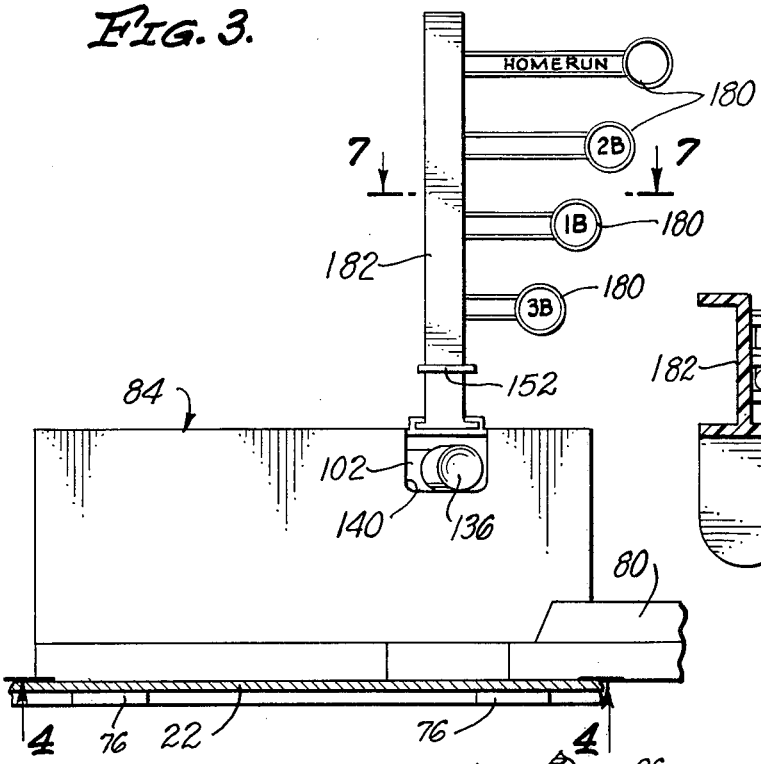
FIG. 3 is a partial cross-sectional view taken at line 3—3 of FIG. 1.
Figure 7:
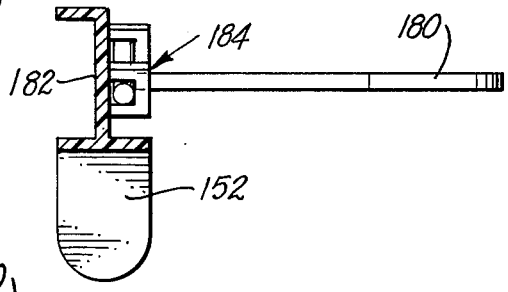
FIG. 7 is a partial cross-sectional view on an enlarged scale taken at line 7—7 of FIG. 3.
Figure 5:
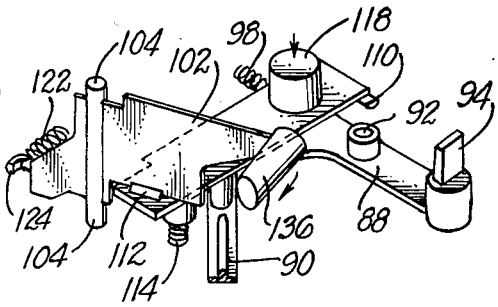
FIG. 5 is an isometric view showing various parts which are utilized in propelling a simulated baseball.
Figure 4:
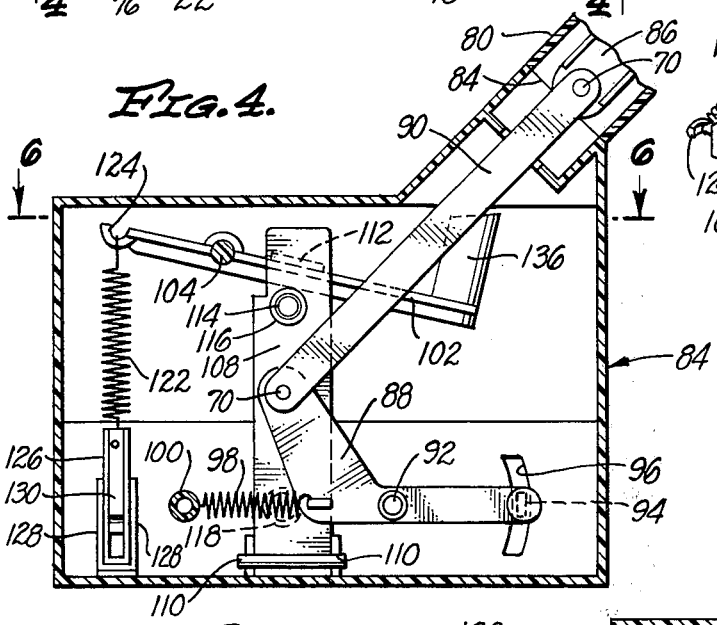
FIG. 4 is a partial cross-sectional view taken at line 4—4 of FIG. 3.
Figure 11:
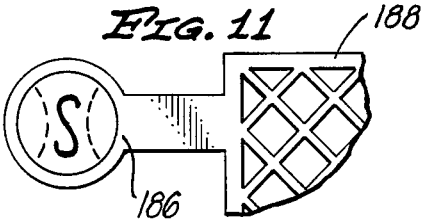
FIG. 11 is a partial cross-sectional view taken at line 11—11 of FIG. 1.
Figure 6:
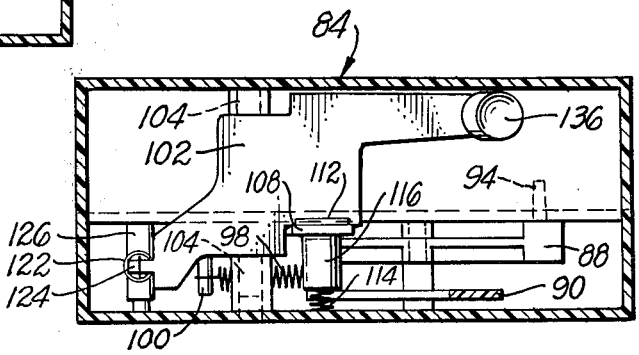
FIG. 6 is a partial cross-sectional view taken at line 6—6 of FIG. 4.
Figure 8:
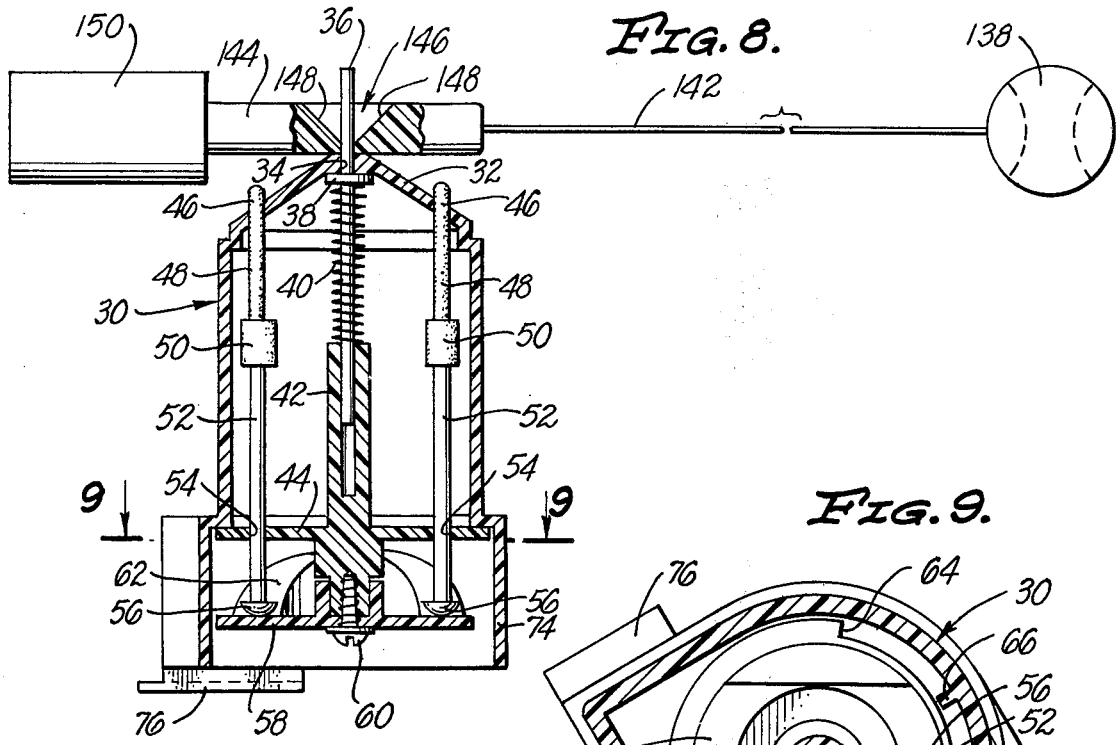
FIG. 8 is a partial cross-sectional view taken at line 8—8 of FIG. 1.
Figure 9:
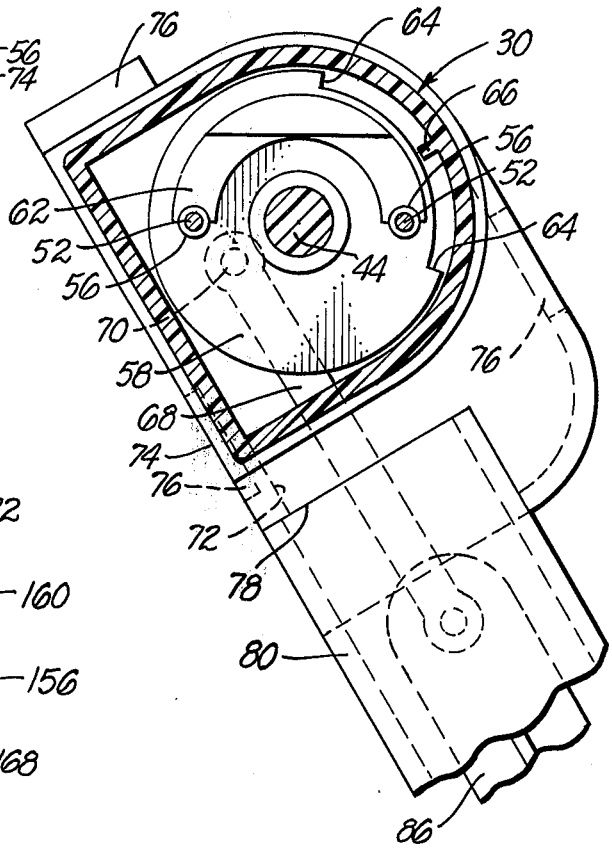
FIG. 9 is a partial cross-sectional view on an enlarged scale taken at line 9—9 of FIG. 8.
Figure 10:
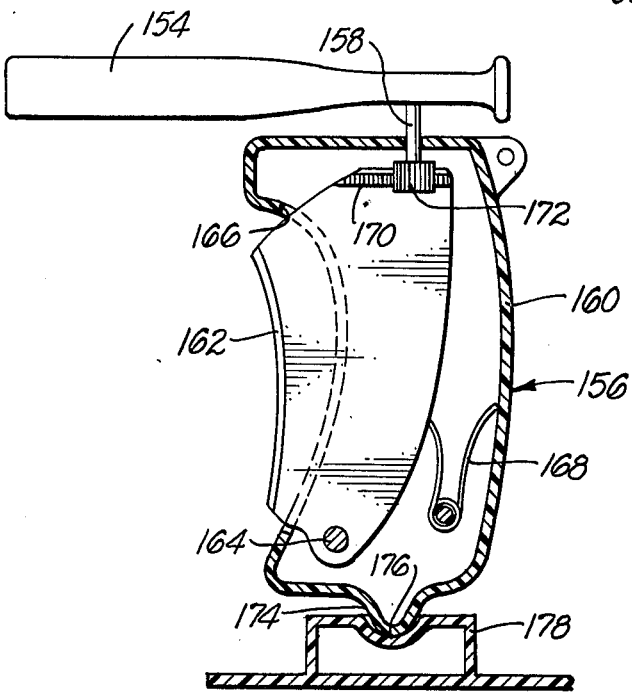
FIG. 10 is a partial cross-sectional view in which certain parts are shown in elevation on an enlarged scale taken at line 10—10 of FIG. 1.

In the game 20 the object of hitting the ball 138 with the bat 154 is to cause the ball 138 to engage any one of a series of targets 180 mounted upon a tower 182. This tower 182 is supported on the structure 84 generally above the extension 136. These targets 180 are preferably held on this tower 182 through the use of conventional pivot connections 184 set at an angle to the vertical so that the targets 180 will be held by contact with the tower 182 in either positions as shown in FIG. 1 and 3 in full lines or in positions at right angles to these positions in which these targets 180 abut against the tower 182.

These targets 180 are of different lengths as indicated in FIG. 1 so as to be located in approximately an arc corresponding to the arc through which the ball 138 can be moved as it is tethered on the structure described. These targets 180 are preferably labeled so as to designate base hits of various types as are achievable in a real game of baseball and a home run corresponding to a home run in the real game of baseball. Because of the two positions of stability of these targets 180 they normally rotate to as great an extent as contact with the tower 182 will allow so as to clearly indicate when a "hit" of any desired type has been achieved.

It will frequently happen that the ball 138 will not be engaged by the bat 154 as the game 20 is played in the manner described. The actuation of the actuator 156 so as to swing the bat without the ball 138 being engaged will normally be counted as a strike as the game 20 is played. Similarly, a strike will normally be indicated by the ball 138 being propelled so as to hit against an area 186 mounted on a simulated backstop 188. This simulated backstop 188 is preferably mounted on the board 22 in any convenient manner.

The game 20 is considered quite unique in the versatility of the manner in which this game can be played. As an example of this, if the game 20 is being played by two persons one of whom is utilizing the actuator 156 and the other of whom is "pitching" the ball 138, the individual engaged in the latter operation may vary the manner in which the ball 138 is propelled toward home plate 24 in several different manners. First of all, through adjustment of the slider 126 such an individual can vary the impact force of the extension 136 against the ball 138 so as to pitch either "slow" or "fast" balls.

Simultaneously, such an individual may also actuate the extension 94 in such a manner that the extremity 144 is is either engaged by one or the other of the holding rods 48 or is not engaged by either of these holding rods 48. These holding rods 48 are disposed in locations where such engagement will occur when the ball 138 is in what is described in the preceding as an "at rest " position. Because of the material used in the rods 48 these rods 48 will frictionally engage the extremity 144 when they are used in such a manner that they will tend to effect the manner in which the ball 138 travels after being hit by the extension 136.

When the game 20 is constructed as described when the extension 94 is in a central-most location within the slot 96 neither of the rods 48 will engage the extremity 144 as the ball 138 is held in an "at rest" position by contact with the ledge 152. With the extension 94 in this position when the button 118 is depressed the ball 138 will be hit so as to tend to travel in a manner simulating the manner in which a real ball travels when a baseball pitcher pitches a so-called "curve ball". The extension 94 may be moved within the slot 96 to either extremity of this slot 96 so as to bring one or the other of the rods 48 into contact with the extremity 144. When one of these rods 48 is extended the ball 138 will move in the manner corresponding to a so-called "high pitch" in the real game of baseball while if the other of the rods 48 is extended the ball 138 will move in a manner corresponding to a "low pitch" in the real game of baseball.

Frequently the mere use of the game 20 in the manner indicated in the preceding discussion will provide adequate amusement for several individuals or several groups of individuals playing against each other as teams. If desired, however, the play value of the game 20 can be increased through the use of conventional score keeping means (not shown or described) and through the use of tokens which are advanced around the various bases 26 as players move in the conventional game of baseball. Such scoring means can conveniently be mounted on the housing 80 and/or can be formed integrally with the housing 80.

I claim:

1. A simulated baseball game having a simulated baseball playing field, a simulated baseball, tether means for controlling the movement of said ball connected to said ball, support means for holding said tether means relative to said playing field connected to said tether means, and simulated bat means for hitting said ball in which the improvement comprises:

said support means including a pylon extending above said playing field, said tether means comprising an elongated arm, said ball being connected to one end of said arm, universal joint means connecting said arm and said pylon for permitting said arm to rotate across said playing field at various levels with respect to said playing field, said pylon and said arm being positioned and dimensioned so that said ball is held in such a manner that it can be rotated between the field area of said playing field and the home plate of said playing field, and propulsion means for hitting said ball to cause said ball to rotate from an at rest position in the field area of said playing field toward and across the home plate of said playing field.

2. A simulated baseball game as claimed in claim 1 wherein:

said arm is a rigid arm, said universal joint means comprises an upwardly extending cone on said pylon, a shaft extending upwardly from the apex of said cone, and an opening in said arm between the ends thereof, said shaft extending through said opening, said opening being shaped so that said arm can rest against said cone while rotating across said playing field at various levels with respect to said playing field, and said tether means also including a counterweight means on the end thereof remote from said ball.

3. A simulated baseball game as claimed in claim 2 wherein:

said opening is a slot leading through said arm, said slot having converging end walls.

4. A simulated baseball game as claimed in claim 1 wherein:

said propulsion means includes a mounting structure, a member for hitting said ball when said ball is at rest adjacent to said mounting structure, said member being movably mounted on said mounting structure, and means for moving said member so as to cause said member to hit said ball when said ball is at rest adjacent to said mounting structure, and holding means for holding said ball at rest adjacent to said mounting structure.

5. A simulated baseball game as claimed in claim 4 wherein:

said member is a pivotally mounted arm, a part of said arm being shaped so as to hit said ball, said means for moving said member comprises a spring engaging said arm and a latch means for holding said member so that said spring can be released to move said arm.

6. A simulated baseball game as claimed in claim 5 including:

adjustment means for varying the tension on said spring when said spring is held by said latch means.

7. A simulated baseball game as claimed in claim 1 including:

positioning means for positioning said ball in a plurality of at rest positions relative to said propulsion means so that the manner in which said arm and said ball will move relative to said playing field when said ball is hit by said propulsion means can be varied by varying the at rest position of said ball.

8. A simulated baseball game as claimed in claim 7 wherein:

said positioning means comprise means for frictionally engaging said arm so that said arm will be released when said ball is hit by said propulsion means.

9. A simulated baseball game as claimed in claim 8 wherein:

said means for frictionally engaging said arm are located on said pylon and physically engage said arm.

10. A simulated baseball game as claimed in claim 8 including:

cam means for moving said means for frictionally engaging said arm relative to said arm so as to vary the at rest position of said ball.

11. A simulated baseball game as claimed in claim 1 including:

a tower located in the field area of said playing field and extending above said playing field, a plurality of targets mounted one above another on said tower at locations where said targets are capable of being engaged by said ball as said ball is rotated across said playing field.

12. A simulated baseball game as claimed in claim 11 wherein:

said targets are pivotally mounted on said tower so as to be capable of being rotated between either of two positions, each of said targets being mounted so that it can be engaged and moved by said ball when in one of said positions.

13. A simulated baseball game as claimed in claim 1 wherein:

said arm is a rigid arm, said universal joint means comprises an upwardly extending cone on said pylon, a shaft extending upwardly from the apex of said cone, and an opening in said arm between the ends thereof, said shaft extending through said opening, said opening being shaped so that said arm can rest against said cone while rotating across said playing field at various levels with respect to said playing field, and said tether means also including a counterweight means on the end thereof remote from said ball, said propulsion means includes a mounting structure, a member for hitting said ball when said ball is at rest adjacent to said mounting structure, said member being movably mounted on said mounting structure, and means for moving said member so as to cause said member to hit said ball when said ball is at rest adjacent to said mounting structure, and holding means for holding said ball at rest adjacent to said mounting structure, said member is a pivotally mounted arm, a part of said arm being shaped so as to hit said ball, said means for moving said member comprises a spring engaging said arm and a latch means for holding said member so that said spring can be released to move said arm, and including positioning means for positioning said ball in a plurality of at rest positions relative to said propulsion means so that the manner in which said arm and said ball will move relative to said playing field when said ball is hit by said propulsion means can be varied by varying the at rest position of said ball, a tower located in the field area of said playing field and extending above said playing field, a plurality of targets mounted one above another on said tower at locations where said targets are capable of being engaged by said ball as said ball is rotated across said playing field.

14. A simulated baseball game as claimed in claim 13 wherein:

said opening is a slot leading through said arm, said slot having converging end walls, said positioning means comprise means for frictionally engaging said arm so that said arm will be released when said ball is hit by said propulsion means, said means for frictionally engaging said arm are located on said pylon and physically engage said arm, said targets are pivotally mounted on said tower so as to be capable of being rotated between either of two positions, each of said targets being mounted so that it can be engaged and moved by said ball when in one of said positions.

15. A simulated baseball game as claimed in claim 14 including:

adjustment means for varying the tension on said spring when said spring is held by said latch means, cam means for moving said means for frictionally engaging said arm relative to said arm so as to vary the at rest position of said ball.

* * * * *